United States Patent [19]

Poe et al.

[11] 4,345,774

[45] Aug. 24, 1982

[54] ROLLER SKATE APPARATUS

[75] Inventors: John C. Poe, Long Beach; Tony Radecki, Altadena, both of Calif.

[73] Assignee: R. C. Sports, Inc., Olathe, Kans.

[21] Appl. No.: 186,166

[22] Filed: Sep. 11, 1980

[51] Int. Cl.[3] ..... A63C 17/14

[52] U.S. Cl. ..... 280/11.2; 280/11.1 R; 280/11.19; 280/11.28

[58] Field of Search ..... 280/11.28, 11.27, 11.26, 280/11.19, 11.2, 11.23, 11.1 R

[56] References Cited

U.S. PATENT DOCUMENTS

| | | | |
|---|---|---|---|
| 2,025,858 | 12/1935 | Harris | 280/11.28 X |
| 2,233,355 | 2/1941 | Ware | 280/11.28 |
| 2,509,324 | 5/1950 | Van Horn | 28/11.28 |
| 2,510,722 | 6/1950 | Snyder | 280/11.28 |
| 2,719,725 | 10/1955 | Ware | 280/11.28 |
| 2,744,759 | 5/1956 | Sternbergh | 280/11.2 |
| 2,797,926 | 7/1957 | Swenson | 280/11.28 |
| 3,035,846 | 5/1962 | Asad | 280/11.2 |
| 3,649,038 | 3/1972 | Huckenbeck | 280/11.28 |
| 3,738,673 | 6/1973 | Iseman | 280/11.28 |
| 4,262,918 | 4/1981 | Sandino | 280/11.26 |

FOREIGN PATENT DOCUMENTS

| | | | |
|---|---|---|---|
| 23095 | of 1911 | United Kingdom | 280/11.28 |

*Primary Examiner*—Richard A. Bertsch
*Assistant Examiner*—Milton L. Smith
*Attorney, Agent, or Firm*—Schmidt, Johnson, Hovey & Williams

[57] ABSTRACT

An improved construction for roller skate apparatus is provided in which enhanced safety, performance, convenience and economy are achieved through the employment of a universal type of skate plate in conjunction with a correlated configuration for wheel carrying trucks adapted for permitting fabrication of the skate plate by molding from synthetic resin material, interchangeable mounting of trucks of either the recreation, speed or artistic skating types to selectively provide the user with various desired skating characteristics without the expense of purchasing multiple pairs of entire skates for different types of skating, interchangeable mounting of trucks at either the front or back of the skate, and selective mounting of a toe stop on the skate plate in a position most appropriate for use of the skate upon either the left or right foot. The features provided by the improved construction have individual utility, as well as accomplishing overall advantages when employed together.

3 Claims, 16 Drawing Figures

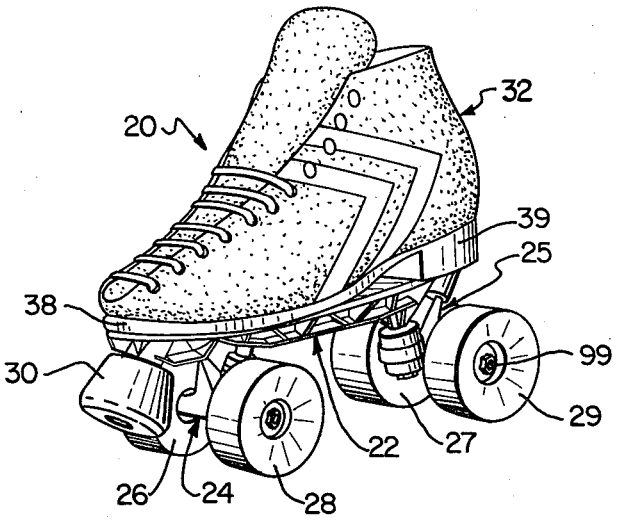
FIG. 1
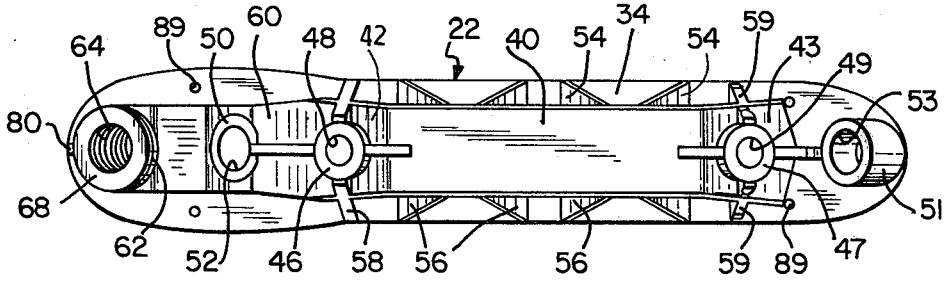
FIG. 2
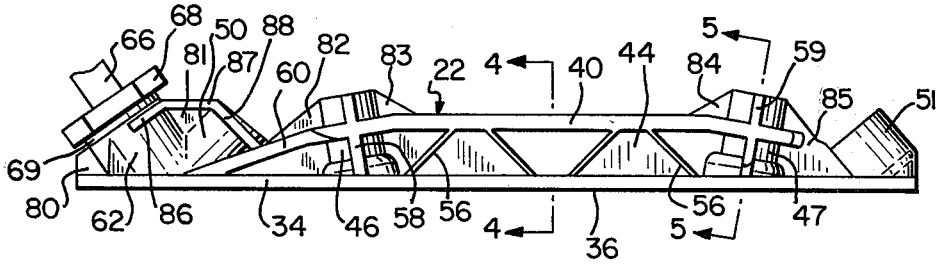
FIG. 3
FIG. 4
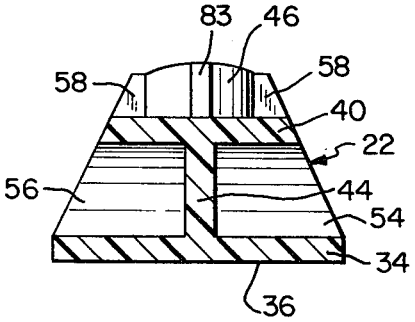
FIG. 5
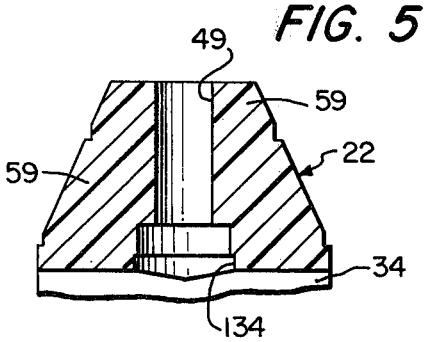

ROLLER SKATE APPARATUS

FIELD OF THE INVENTION

This invention relates to roller skate apparatus and, more particularly, to various related aspects of an improved construction for roller skates, which yield significant advantages for both the manufacturer and the user in terms of safety, performance, convenience and economy.

DESCRIPTION OF THE PRIOR ART

In recent years, roller skating has become increasingly popular with persons of various ages, not only for purposes of general recreation and healthful exercise, but also as offering fields for acquiring special skills or engaging in competition involving racing or artistic skating. With the changed status of the roller skate from what once was typically considered to be merely a simple child's toy into what is now widely regarded as a sophisticated type of athletic equipment have come demands for greater versatility and performance from a variety of users, many of whom are typically interested in engaging in differing types of skating on different occasions.

The wider spectrum of users and the more exacting nature of their requirements for what should constitute satisfactory roller skate apparatus has created a number of problems for both manufacturers and users of such equipment. In general, the solutions heretofore proposed to resolve such problems have typically been addressed primarily to individual ones of the latter, and, since the problems presented and the most natural avenues of approach thereto on an individual basis tend to involve related but mutually somewhat incompatible considerations, the previously proposed solutions to individual problems have typically rendered other of the problems even more serious.

For example, the greater weights and stresses placed upon skates by adult users, and especially so when the skates are to be employed in racing or artistic types of skating, require substantially increased strengths and resistance to either breaking or torsional effects, particularly in the skate plate part of the apparatus. In recognition of that problem, the most recent, known, prior approach has been to cast the skate plate part out of metal with a generally "Y-shaped" cross-sectional configuration. Another of the problems requiring solution in a fully satisfactory skate for modern usage, however, is the minimization of weight of the over-all skate apparatus, to which the skate plate part is a primary contributor. Even when the skate plate is cast out of aluminum, and even when it is formed with the mentioned generally "Y-shaped" transverse cross-sectional configuration, however, the weight factor contributed thereby is still significant and objectionable to many users. Moreover, particularly if the cavity in the upper face of the skate plate provided by the "Y-shaped" transverse cross-sectional construction is relatively deep, to minimize weight, not only are the actual areas of support provided for the user's foot reduced (requiring a thicker-soled shoe for comfort), but the structural integrity of the skate plate may be reduced to an extent such that its satisfaction of safety considerations is impaired or becomes marginal. In fact, with any configuration of skate plates cast from aluminum which would be practical from the weight standpoint, it has been found that breakage or other failure may occur when the skate is subjected to some types of stresses. Besides those considerations, cast aluminum skate plates are relatively expensive to fabricate, which is a material contributing factor to the rising cost of modern roller skate apparatus that has recently heretofore risen to a level tending to deny availability of the better grades of roller skates to a number of otherwise potential users.

It has previously been recognized that skates to be used for specialized purposes, such as speed or "figure" skating, can be optimized for those purposes through appropriately differing mountings of the ground engaging wheels upon the skate plate, particularly with respect to the relative locations of the axes of the front and rear wheels relative to the skate plate, as well as through appropriately altered resistance offered to translation of the axes of the wheel carrying axles about certain axes of mounting of the so-called "trucks" upon which the wheels are carried relative to the skate plate. The parameters for thus optimizing a skate for use in the mentioned types of specialized skating differ not only from each other but from those which are most appropriate for general purpose, recreational type skating. The approach heretofore taken with regard to this problem has essentially involved providing distinctly different types or models of skates each embodying suitably configured trucks or other wheel mountings for each particular type of skating, with the expectancy that the user should necessarily purchase a different pair of skates for each type of skating to be done. Manifestly, such previous approach involves significant economic waste, as well as also tending to limit the practical availability of roller skating apparatus for specialized purposes to only those users who can afford to purchase more than one pair of skates. The separate pair of specialized skates for each type of skating approach has, at least in part, survived through what we have found to be the erroneous assumption that the axes about which the wheel bearing trucks are mounted on the skate plate and resiliently shiftable relative to the latter should be different for each particular type of skating activity.

Another problem, which has created both economic waste and inconvenience for both manufacturers and users, arises from the fact that the toe stops employed at the front of roller skates function best if they are disposed to one side of the center line of the skate plate in different directions for skates intended for use on the right foot and left foot respectively. The previous approach to this problem in some instances has been simply to mount the toe stop in the same location upon the skate plate for both right and left skates, while in premium grade skates for specialized purposes the right and left skates have been manufactured with appropriately different configurations for mounting the toe stop in the particular offset portions that are optimum for right and left skates respectively.

In general, prior "piece-meal" efforts to provide individual solutions to the various problems involved in optimizing the construction of roller skate apparatus have failed to provide an integrated solution to the over-all satisfaction of problems involved from the standpoints of safety, performance, convenience and economy.

SUMMARY OF THE INVENTION

The present invention provides an improved construction for roller skate apparatus in which integrated attention is given to the correlated solution of the various individual problems involved in optimizing roller skate apparatus for multi-purpose use by a maximum number of users, while improving upon the safety, performance, convenience and economy characteristics of roller skate apparatus generally.

The improved construction employs skate plates molded in unitary form from synthetic resin materials with a "truss-braced," dual plate, structural configuration providing enhanced strength and safety, reduced weight and distortion, simplification of fabrication and significant cost savings; further employs an arrangement permitting various types of wheel bearing trucks optimized for corresponding types of specialized skating activities to be interchangeably and conveniently mounted upon a universal type of skate plate, with resultant increased convenience and cost savings for both manufacturers and users, while avoiding the necessity of fabrication, distribution and purchase of separate pairs of skates for each intended type of usage; and further employs a toe stop mounting arrangement on the skate plate that permits the toe stop to be selectively mounted in alternate positions appropriately offset to one side or the other of the universal skate plate, thereby resulting in further convenience and economies for both manufacturers and users by eliminating the necessity of different skate plate configurations for left and right skates, while achieving the improved performance characteristics that accrue from having the toe stop optimumly positioned on left and right skates.

The structural aspects of the improved construction will be further elaborated upon with reference to the illustrative embodiments of the invention shown in the accompanying drawings and hereinafter described.

BRIEF DESCRIPTION OF THE DRAWINGS

In the accompanying drawings:

FIG. 1 is a perspective view of a roller skate illustrating a preferred embodiment of our improved construction for roller skate apparatus;

FIG. 2 is a bottom plan view of one form of skate plate illustrating the molded plastic structuring and universal truck supporting aspects of our improved construction;

FIG. 3 is an inverted, side elevational view of the skate plate of FIG. 2;

FIG. 4 is a transverse cross-sectional view taken on line 4—4 of FIG. 3;

FIG. 5 is a transverse cross-sectional view taken on line 5—5 of FIG. 3;

DESCRIPTION OF THE PREFERRED EMBODIMENTS

Figure 6:
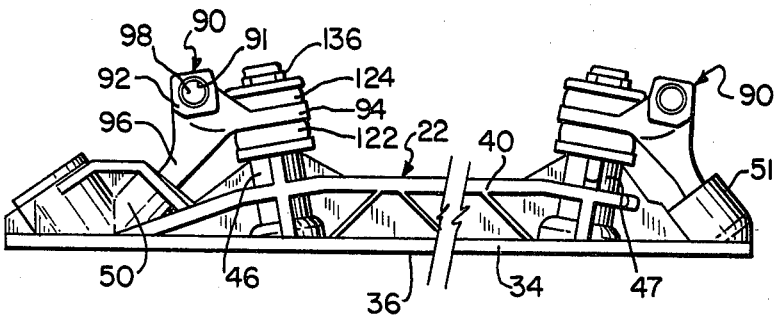
FIG. 6 is an inverted, side elevational view of front and rear end parts of the skate plate of FIG. 2 illustrating a pair of recreational skating type trucks mounted thereon.

A skate embodying our improved construction is perspectively illustrated in FIG. 1, from which certain of the primary components may be initially identified. The improved skate generally designated 20 includes: an elongate skate plate assembly 22; a front truck assembly 24 beneath a generally forward part of the skate plate 22 and mounted on the latter; a rear truck assembly 25 beneath a rearward part of the skate plate 22 and mounted on the latter; a pair of front, ground engaging wheels 26 and 28 rotatably mounted on the front truck 24; a pair of rear, ground engaging wheels 27 and 29 rotatably mounted on the rear truck 25; a toe stop assembly 30 beneath a forwardmost part of the skate plate 22 and mounted on the latter; and some suitable means for securing the skate plate 22 to the foot of a user, which may typically be a shoe 32 appropriately secured by threaded fastening means (not shown) or otherwise suitably interconnected with the skate plate 22.

Before leaving FIG. 1, it should be noted that, although the shoe 32 will necessarily differ for right and left skates 20, the other parts of the skate 20 with which our improved construction is directly concerned will be identical for both right and left skates 20. Moreover, it may be appropriate to here reiterate that our improved construction contemplates and allows each skate 20 to be provided with only a single, universal skate plate 22, regardless of the type of skating for which the skate 20 is to be used; also permits free front to rear interchangeability between front and rear trucks 24 and 25, so that the latter may be identical in construction for any given type of trucks 24 and 25; and further contemplates that each skate 20 may, and preferably will, be made available to users with sets of various types of conveniently interchangeable trucks 24 and 25, which can be selectively employed on the same skate plate 22 (and shoe 32) for different types of skating activity.

Figure 10:
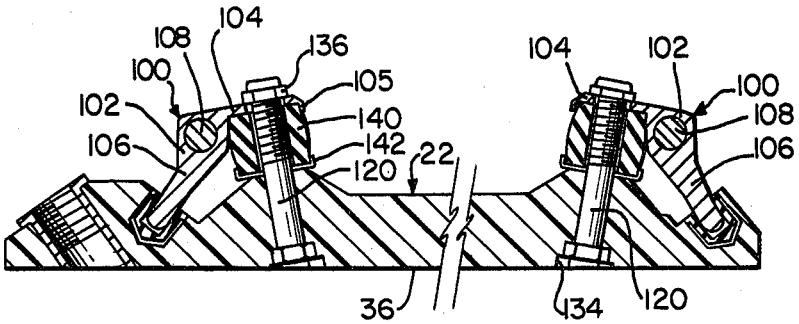
FIG. 10 is a longitudinal cross-sectional view of the skate plate and speed trucks of FIG. 7, with the optional auxiliary bracing strip omitted.
Figure 11:
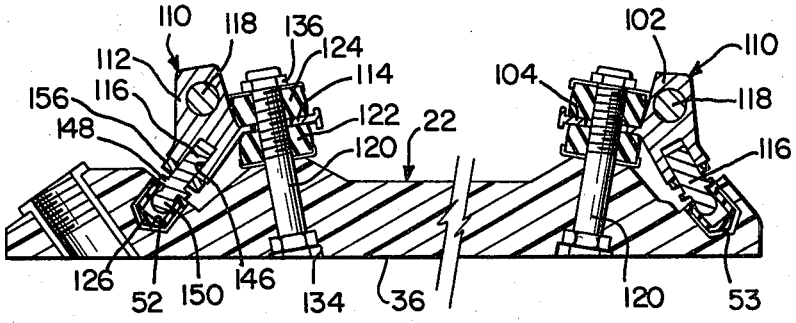
FIG. 11 is a longitudinal cross-sectional view of the skate plate and artistic trucks of FIG. 8.
Figure 12:
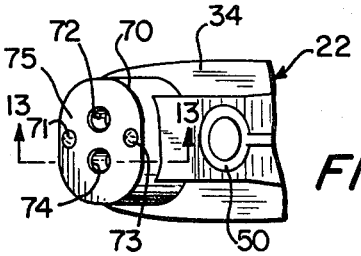
FIG. 12 is a fragmentary, bottom plan view of a front part of a modified form of skate plate illustrating the adjustable toe stop mounting aspect thereof, which is an optional but preferred feature of our improved construction.
Figure 13:
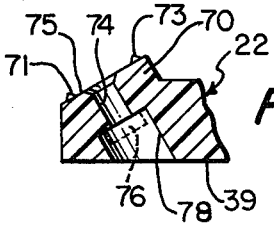
FIG. 13 is a fragmentary, longitudinal cross-sectional view taken on line 13—13 of FIG. 12.

Turning attention next to FIGS. 2–5, our improved construction for the skate plate 22 is shown in its currently preferred form, with the possible exception that the part of the skate plate 22 employed for mounting the toe stop 30 can be configured either in the centered toe stop form depicted in FIGS. 2–11 or in the improved, selectively offsetable form depicted in FIGS. 12 and 13 (our current preference being for the latter, especially for users who engage in artistic skating, although some users who have become accustomed to the centered toe stops of most earlier skates may still prefer the former).

The skate plate 22 is preferably fabricated by molding the same as a unitary, structural body from synthetic resin material, such as the nylon plastic material product available from E. I. DuPont de Nemours & Co. under the trade designation "ZYTEL ST801 Super Tough." Although equivalent materials could likely be employed, the mentioned synthetic resin has been found to adapt well to injection molding techniques and, when the molded material has become hardened, it is highly rigid and of surprising strength for body sections of the order of dimensions herein contemplated.

In order to fully realize the advantages of this aspect of our improved construction with respect to weight reduction and convenience and economy of fabrication, while also providing the non-deformability and resistance to breakage characteristics required for performance and safety purposes, however, more than merely substituting suitable, molded, synthetic resin material for cast aluminum in a conventional prior configuration such as previously employed with the latter is necessary. The answer in such regard has been found to involve configuring the skate plate 22 in a structural form that is radically different from any of those previously used in skate plates of the cast aluminum type, and along lines at least generally equivalent to the preferred construction next described.

Our improved, synthetic resin, skate plate 22 includes, as primary parts of its unitary, molded body: an elongate, upper plate portion 34, which is of substantially uniform thickness, is generally horizontal, and provides a substantially flat upper surface 36 for comfortably supporting sole and heel sections 38 and 39 respectively of a shoe 32 thereon; an elongate, lower plate portion 40, which is spaced below the upper plate portion 34, is of substantially uniform thickness, is generally horizontal (although preferably having forward and rearward sections 42 and 43 thereof inclined somewhat upwardly along planes of perpendicularity to the axes of the sleeve portions hereinafter identified), and is shorter and preferably narrower than the upper plate portion 34, so as to underlie only a longitudinally and laterally intermediate area of the latter; an elongate, medial rib portion 44, which is of substantially uniform thickness and extends generally vertically between laterally central zones of the upper and lower plate portions 34 and 40; a front, tubular sleeve portion 46, which extends between the upper plate portion 34 and the lower plate portion 40 (and preferably below the latter, as illustrated) and has a generally cylindrical bore 48 whose axis inclines downwardly and forwardly at an angle of preferably about 10 degrees from perpendicularity with the general plane of the surface 36; a rear, tubular sleeve portion 47, which extends between the upper plate portion 34 and the lower plate portion 40 (and preferably below the latter, as illustrated) and has a generally cylindrical bore 49 whose axis inclines downwardly and rearwardly at an angle of preferably about 10 degrees from perpendicularity with the general plane of the surface 36; a front cup portion 50, which depends from the upper plate portion 34 forwardly of the front sleeve portion 46 and has a generally cylindrical cavity 52 whose axis inclines downwardly and rearwardly at an angle of preferably about 30 degrees from perpendicularity with the general plane of the surface 36; a rear cup portion 51, which depends from the upper plate portion 34 rearwardly of the rear sleeve portion 47 and has a generally cylindrical cavity 53 whose axis inclines downwardly and forwardly at an angle of preferably about 30 degrees from perpendicularity with the general plane of the surface 36; and laterally extending bracing means including a plurality of bracing rib portions as at 54 and 56 extending between the upper and lower plate portions 34 and 40 from opposite sides of the medial rib portion 44 and successively oppositely inclined longitudinally of the plate portions 34 and 40 in trussing relationship to the latter, front and rear sleeve bracing elements 58 and 59 inclined at about the same angles as the axes of the bores 48 and 49 of the front and rear sleeve portions 46 and 47 and extending from the upper plate portion 34 preferably beyond the lower plate portion 40 toward the lower extremities of the sleeve portions 46 and 47, and preferably an extra forward bracing member 60 inclined rearwardly and downwardly from the upper plate portion 34 so as to merge into the lower plate portion 40 as an extension of the latter to provide additional strength at the front part of the skate 20 where stresses may be greatest (especially in artistic skating).

The unitary skate plate 22 will preferably also include appropriate provision for mounting the toe stop 30 thereon. In FIGS. 1–11, the means provided for such purpose contemplate centered mounting of the toe stop 30, as has heretofore been most common in all except the most expensive skates in order to avoid the cost of fabricating differing skate plates for the right and left skates. In such embodiment, the skate plate 22 is integrally provided with a tubular, toe stop supporting, sleeve portion 62 adjacent the forward end of the upper plate portion 34 and having a bore 64 whose axis extends downwardly and forwardly approximately along the longitudinal median line of the skate plate 22 at an angle of about 30 degrees from perpendicularity with the general plane of the upper plate surface 36; and a threaded mounting bolt 66 forming a part of the toe stop assembly 30 (shown only fragmentarily in FIG. 3) may be conventionally mounted on the sleeve portion 62 by means of threaded mating of the bolt 66 with a frontal lock nut 68 and either internal threads in the bore 64 (or in a bushing 69 tightly fitted therein, as illustrated) or in a backing nut (not shown) recessed into the surface 36 of the upper plate portion 34.

Our preferred construction for providing selectable and optimally offset mounting for the toe stop 30 in universal skate plates 22 for either right or left skates 20 is illustrated in FIGS. 12 and 13, however, and will be seen to involve a laterally enlarged toe stop mounting, sleeve portion 70 depending from the upper plate portion 40 and having a pair of bores 72 and 74 laterally offset to either side of the longitudinal median line of the skate plate 22 and extending downwardly and forwardly at an angle of about 30 degrees from perpendicularity with the surface 39 of the upper plate portion 34. We prefer to selectively mount the toe stop assembly 30 by passing the conventional mounting bolt part thereof through a frontal lock nut, the appropriate bore 72 or 74 and a rear lock nut (indicated in dotted lines at 76 in FIG. 13 within a recess 78 provided for that purpose in the surface 39), in the general manner previously described for the bolt 66, lock nut 68, etc., although employment of a toe stop 30 with a mounting bolt part of somewhat smaller diameter than illustrated for the bolt 66 is desirable to accommodate to the correspondingly smaller diameters of the bores 72 and 74 as compared with the single central bore 64 of the sleeve portion 62. With our molded skate plate 22, we also prefer to provide a pair of generally conical projections 71 and 73 on the end surface 75 of the sleeve portion 70 for assisting in retaining the frontal lock nut from inadvertently loosening. It is noted that our improved construction for selective mounting of the toe stop 30 also has separate utility even with otherwise conventional cast aluminum skate plates, in which case the bores 72 and 74 may be threaded to receive the bolt part of the toe stop 30.

Returning attention to FIGS. 2–11, certain further significant details of our preferred form of molded skate plate 22 should be pointed out. Additional strength is preferably provided in the skate plate 22 by vertically extending reinforcing webs substantially aligned with the medial rib portion 44, as at 80 on the front of the toe stop mounting sleeve portion 62, at 81 between the toe stop mounting sleeve portion 62 and the front cup portion 40, at 82 and 83 below the lower plate portion 40 and to the front and rear of the front sleeve portion 46, at 84 below the lower plate portion 40 and to the front of the rear sleeve portion 47, and at 85 between the rear sleeve portion 47 and the rear cup portion 51. We also prefer to provide laterally extending further reinforcing for the toe stop mounting sleeve portion 62 and the front cup portion 50 in the form of an auxiliary bracing plate extending downwardly and rearwardly from the back part of the sleeve portion 62 as at 86, then rearwardly to the cup portion 50 as at 87, thence rearwardly and upwardly around the cup portion 50 and to the extension member 60 as at 88. The upper plate portion 34 also has a plurality of holes as at 89 to pass threaded fasteners (not shown) used to secure the skate plate 22 to the shoe 32. For illustration only, an adult size skate plate 22 in accordance with our improved construction may be, say, about 11 inches long, with the upper plate portion 34 about 2 inches wide at its middle, the lower plate portion 40 about 6½ inches long and about1⅜ inches wide, the plate portions 34 and 40 each about ⅜ inch thick, the medial rib portion 44 about the same (or slightly less) thickness as the plate portions 34 and 40, the truss bracing portions 54 and 56 about 1/16–⅛ inch thick, and the other bracing and reinforcing parts generally about ⅛ to ¼ inch thick; the mentioned dimensions are, of course, relatively interdependent upon each other, upon the material and molding process used, and upon the ultimate strength desired, and thus are intended merely as exemplary.

What is believed significant, however, is that, with the improved construction disclosed (or an equivalent), the modified truss braced, narrowed bottom, "I-beam," unitary, molded, synthetic resin, skate plate 22 provided by this invention makes it possible to markedly increase the strength to weight relationship over that attainable with conventional cast aluminum skate plates, as well as to enjoy substantially reduced costs and increased fabricating convenience at the same time.

Figure 14:
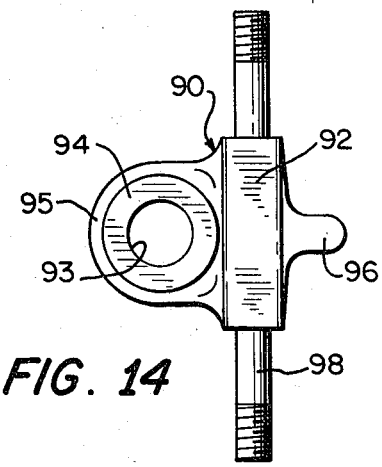
FIG. 14 is a bottom plan view of a recreational type truck included as one of the interchangeable types of trucks contemplated by our improved construction.
Figure 15:
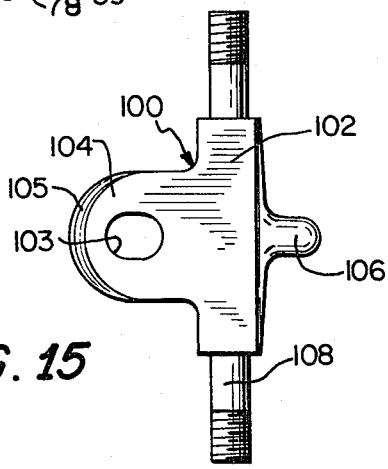
FIG. 15 is a bottom plan view of a speed type truck included as another of the interchangeable types of trucks contemplated by our improved construction.
Figure 16:
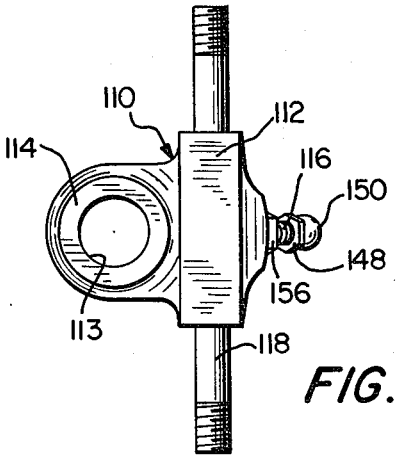
FIG. 16 is a bottom plan view of an artistic type truck included as another of the interchangeable types of trucks contemplated by our improved construction.

Reference is next made to FIGS. 14–16, which show a set of three truck assemblies, including a recreational truck 90, a speed truck 100 and an artistic truck 110, which may be regarded as parts of the overall, improved, universal skate apparatus 20 contemplated by this invention, and which are each of configurations that cooperate with certain aspects of the configuration of the skate plates 22 to render the trucks 90, 100 and 110 interchangeably usable on the skate plates 22 from the standpoint of user selection and assembly, while thereby also allowing the user full control over the functional characteristics of the skates 20 without the need to possess a different pair of skates for each type of skating activity in which the user will engage. Moreover, the mentioned relationship of interchangeability extends not only to the matter of front or rear mounting of all trucks of any given type 90, 100 or 110, but also to selectable use of trucks of all of such types.

It has been previously noted that the axis of each of the front and rear sleeve portions 46 and 47 inclines downwardly and toward the axis of its corresponding cup portion 50 or 51 at an angle of about 10 degrees from perpendicularity with the substantially horizontal general plane of the upper surface 36 of the upper plate portion 34 of the skate plate 22, and that the axis of each of the front and rear cup portions 50 and 51 inclines downwardly and toward the axis of its corresponding sleeve portion 46 or 47 at an angle of about 30 degrees from perpendicularity with the same plane. This alone would have heretofore been generally regarded as precluding effective use of at least any known previous type of speed truck on the skate plates 22, since the "action-axis" (such as provided by the sleeve portions 46 and 47 of the skate plate 22) for a speed truck was generally accepted as needing to be at about a 45 degree angle from vertical for satisfactory performance of a speed truck, and the previously preferred angle from vertical for the "pivot-axis" (such as provided by the cup portions 50 and 51, or/and the assumed "correct" angle of intersection between each "action-axis" and its associated "pivot-axis" (about 40 degrees in the skate plate 22), for various types of trucks were also quite different from that employed in the skate plate 22. The ability of our improved skate apparatus 20 to provide vitally needed truck interchangeability with high performance for each type of truck is based, in part, on the discovery that the prevalent earlier assumptions concerning supposedly optimum angles of inclination of "action-axes" and "pivot-axes" and the angle of intersection therebetween were essentially unfounded and, in remaining part, upon the improved, cooperative truck and skate plate configurations embodied in our improved skates 20.

Before proceeding to more detailed consideration of the configurations of the trucks 90, 100 and 110, it should be noted with regard to the improved skate plates 22 that the levels of the sleeve portions 46 and 47 and the spacing between each of the latter and its corresponding cup portion 50 or 51 are substantially the same and such that the levels at which each "action-axis" and its corresponding "pivot-axis" intersect below the skate plate 22 are substantially the same.

Figure 9:
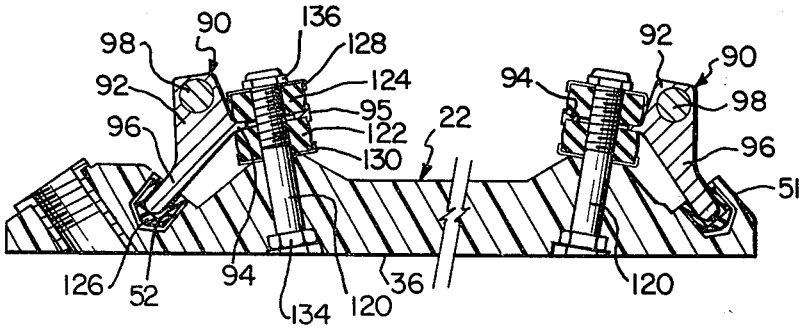
FIG. 9 is a longitudinal cross-sectional view of the skate plate and recreational trucks of FIG. 6.

Referring next to the recreational truck 90 shown in FIGS. 14, 6 and 9, it will be seen to broadly include a body of cast aluminum integrally having an axle carrier part 92, a mounting flange part 94, and an elongate pivot prong part 96. An elongate axle 98 extends through and is press fitted or otherwise suitably secured in a bore 91 extending through the carrier part 92 in a direction generally transverse to the skate plate 22 when the truck 90 is mounted on the latter. The flange part 94 has a central aperture 93 for passing an action bolt 120 used in mounting, and a peripheral lip 95 extending upwardly and downwardly for "cupping" the adjacent ends of upper and lower, resilient, tubular cushioning collars 122 and 124 formed of rubber or plastic material. The exposed end portions of the axle 98 rotatably mount the ground engaging wheels 26 and 28 (or 27 and 29, as the case may be, since the recreational truck 90 may interchangeably serve as either the front truck assembly 24 or the rear truck assembly 25 shown in FIG. 1). The ends of the axle 98 are threaded as at 97 for receiving wheel retaining nuts 99 (see FIG. 1).

The recreational truck 90 is releasably mounted on the front section of the skate plate 22 by inserting the distal end of the pivot prong 96 into a resilient grommet 126 within the concavity 52 of the cup portion 50 of the skate plate 22 and by passing the action bolt 120 having a head 132 downwardly through a recess 134 in the surface 36 of the upper plate portion 34, the bore 48 of sleeve portion 46, an upper cushion positioning cup 130, the upper cushion 122, the aperture 93 of the flange part 94, the lower cushion 124 and a lower cushion positioning cup 128, into threaded relationship with a holding nut 136. Another recreational truck 90, which is identically configured but merely reversed in front-to-rear orientation, is mounted in identical fashion in the sleeve portion 47 and the cup portion 51 adjacent the rear of the skate plate 22. The holding nut 136, which is exposed below the skate plate 22, may be adjustably tightened by the individual user to provide the particular "feel" that he prefers when utilizing the skate apparatus 20 with the recreational trucks 90 installed on the skate plate. In the recreational trucks 90, the aperture 94 is preferably circular and of sufficiently larger diameter than the action bolt 120, so as to provide a somewhat loose fit therebetween permitting that degree of tilting of the trucks 90 in either direction relative to the bolts 120 (dampened, of course, by the resilient effect of the cushions 122 and 124) that is normally regarded as desirable for general purpose, recreational type skating.

For the recreational trucks it should be observed as significant that the upwardly facing angle of divergence between the primary plane of the mounting flange part 94 and the longitudinal axis of the pivot prong part 96 is about 130 degrees; that the axis of the axle 98 is at a substantially lower level than the primary plane of the flange part 94 and displaced significantly forwardly of the axis of the prong part 96; and that the flange part 94 is resiliently "floating" between the cushions 122 and 124 respectively thereabove and therebelow. It is by virtue of these parameters that the trucks 90 provide the skating characteristics best suited for general recreational skating.

Figure 7:
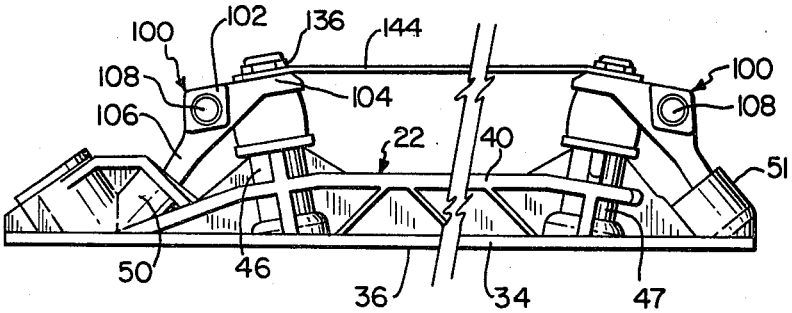
FIG. 7 is an inverted, side elevational view similar to FIG. 6, except illustrating a pair of speed skating type trucks interchangeably mounted on the skate plate, and also showing an auxiliary longitudinal bracing strip extending between the trucks that may optionally be employed by certain speed skaters.

The speed truck 100 shown in FIGS. 15, 7 and 10 may next be considered and will be seen to broadly include, generally similarly to the recreational truck 90, a body of cast aluminum integrally having an axle carrier part 102, a mounting flange part 104, and an elongate pivot prong part 106. The speed truck 100 itself differs in physical configuration from the recreational trucks 90 just described primarily in the respects that the carrier part 102 extends laterally of the skate 20 a greater distance in each direction than the carrier part 92, in order to provide still greater support for the increased stresses applied during speed skating to the laterally extending stretches of an axle 108 press fitted into the carrier part 102; that the flange part 104 includes a lip 105 that extends only upwardly from the primary plane of the flange part 104 to provide an upwardly facing, positioning cup for a single, tubular, cushion 140 employed in mounting each of the speed trucks 100; that the form of an aperture 103 provided in the flange part 104 is somewhat smaller and narrower in the direction normally lateral to the skate 20 to provide a closer fit with an action bolt 120, and thereby the greater resistance to lateral tipping of the axle 108 relative to the axis of the bolt 120 that is normally desired for speed skating; and that the axis of the axle 108 and the primary plane of the flange part 104 are arranged relatively quite differently in the speed truck 100 than in the recreational truck 90.

More specifically in the last-mentioned regard, and quite significantly from the standpoint of providing speed trucks 100 that are adapted for high performance while being suited for use with the skate plate 22 on a basis interchangeable with the recreational trucks 90 and the artistic trucks 110, the primary plane of the flange part 104 extends from the bottom of the carrier part 102 (rather than from a level intermediate of the bottom of the carrier part and the top of the pivot prong part as in the recreational trucks 90), and the axle 108 is thereby disposed with its axis both relatively higher and closer to the surface 36 and only slightly displaced longitudinally of the skate 20 from the axis of the prong part 106, as compared with the previously described recreational trucks 90. The mounting of each speed truck 100, which are front-to-rear interchangeable with each other, upon the skate plate 22 is accomplished in fashion similar to that described for the recreational trucks 90, except that only a single cushion 140 of greater axial dimension than either of the cushions 122 and 124 is employed and only a single cushion positioning cup 142 is required at the top end of the cushion 140 whose lower end is positioned within the cup presented by the lip 105 of the flange part 104 of each of the speed trucks 100. Ground engaging wheels 26 and 28 will be rotatably mounted upon the axle 108 of the speed truck 100 employed at the front of the skate 20, and wheels 27 and 29 will be similarly mounted upon the axle 108 of the speed truck 100 employed at the rear of the skate 20. Although the wheels 26 et seq. may be removed from one type of trucks 24 and 25 when replacing the same with interchangeably mountable trucks of a different type, merely through appropriate manipulation of the retaining nuts 99, many skaters prefer to employ different sets of wheels 26 et seq. for differing types of skating (due either to the differing types of wear that occur or, perhaps, a preference for using wheels 26 et seq. of differing types for different forms of skating), so that optimumly a given pair of wheels may be more or less regularly associated with and left mounted upon each of the interchangeable trucks 24 or 25. There is also illustrated in FIG. 7 only, an optional, longitudinal strap 144 that some speed skaters may desire to employ when using the speed trucks 100, in order to provide greater longitudinal uniformity of spacing between the axles 108 of the front and rear trucks 100; when such a strap 144 is used, it is mounted with holes therein adjacent the opposite ends thereof (not shown) fitted over the lower ends of the action bolts 120 of the front and rear trucks 100 before the holding nuts 136 are emplaced upon the bolts 120.

Figure 8:
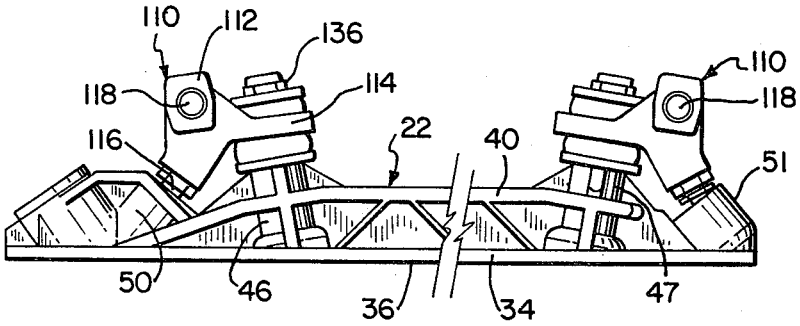
FIG. 8 is an inverted, side elevational view similar to FIG. 6, except illustrating a pair of artistic skating type trucks interchangeably mounted on the skate plate.

Reference is next made to FIGS. 16, 8 and 11, which illustrate in greater detail the nature of the artistic trucks 110. Each truck 110 is virtually identical in configuration to the previously described construction for the recreational trucks 90 and is mounted upon the skate plate 22 in virtually the same fashion, except that in the artistic type truck 110 the pivot prong part 116 is in the form of a bolt adjustably mounted within an internally threaded cavity 146 in the carrier part 112. The bolt 116 providing the "pivot-axis" has an external flange 148 and a ball-like distal end 150 that is fitted into the resilient grommet 152 within the cavity 52 or 53 of the front or rear cup portions 50 or 51, as the case may be. The bolt 116 may be secured in any position of extension thereof from the carrier part 112 of the artistic truck 110 by means of a locking nut 156. The adjustably extensible bolt 116 providing the pivot prong part for the artistic trucks 110 permits the user to "fine tune" the level of the axis of the axle part 118 at a variable level beneath the surface 36 of the skate plate 22 to best accommodate to such individual user's style of artistic skating. As previously noted, the mounting of the flange part 114 of the artistic trucks 110 is similar to that described for the recreational trucks 90, and the primary parts involved are, therefore, merely similarly numbered without further description.

It should be observed that, in all of the interchangeable trucks 90, 100 and 110, despite the other differences existing between their respective configurations, all provide an upwardly facing angle of convergence of about 130 degrees between the flange part 94, 104 or 114 and the axis of the pivot prong part 96, 106 or 116 thereof, so that all of such trucks 90, 100 and 110 are interchangeably mountable upon the skate plate 22, both with respect to each other and with respect to the front or rear positioning thereof. It should also be noted that the toe stop assembly 30, being removably mounted on the skate plate 22, in either of the described forms of the latter, may be removed if and when that should be desired by a user during particular types of skating, such as during speed skating. It is believed significant that that aspect of the improved construction involving the interchangeability of the trucks 90, 100 and 110 and the universal nature of the skate plate 22 for accommodating such interchangeability, although yielding the greatest advantages as to over-all improvement of the skate apparatus 20 when employed in conjunction with the improved form of molded, synthetic resin skate plate 22 described, also would have utility of itself if applied to skate plates more conventionally fabricated from cast aluminum.

It is believed apparent that our improved construction for roller skate apparatus 20 is well-suited to the accomplishment of the various advantages and benefits previously noted from the standpoints of both manufacturers and users. It is to be understood, however, that various details of our currently preferred embodiments described hereinabove and shown in the drawings for illustrative purposes could be modified to a certain extent without departing from the real spirit and essence of the invention. Accordingly, it is contemplated that the claims which follow should be liberally construed and interpreted to encompass roller skate constructions of both the types expressly covered by their language and of types constituting mechanical equivalents of the latter.

We claim:

1. In roller skate apparatus of the general type wherein each skate for use in a right and left pair thereof has elongate skate plate means, means adapted for securing said skate plate means to a foot of a user with said skate plate means disposed beneath the foot of the user and longitudinally extending generally horizontally and in the general direction of intended travel of the skate, a pair of truck means each including axle means carried thereby, means for mounting said pair of truck means at respectively forward and rearward locations on said skate plate means with the respective axes of said axle means of said pair of truck means disposed beneath said skate plate means, extending generally horizontally and laterally with respect to said skate plate means, and spaced from each other longitudinally of said skate plate means, and a pair of ground engaging wheel means respectively mounted for rotation upon said axle means of said pair of truck means, an improved construction for said apparatus including:

there is provided toe stop means, said structure further includes as an integrally formed part thereof means presenting a pair of laterally offset holes in said skate plate means adjacent the forward end thereof, and there is provided releasable fastening means for securing said toe stop means to said skate plate means in association with either of said holes, whereby the same toe stop means and fastening means may be employed for skates intended for use on either the right foot or the left foot of a user merely by mounting said toe stop means in association with the appropriately corresponding one of said holes.

2. In roller skate apparatus of the general type wherein each skate for use in a right and left pair thereof has elongate skate plate means, means adapted for securing said skate plate means to a foot of a user with said skate plate means disposed beneath the foot of the user and longitudinally extending generally horizontally and in the general direction of intended travel of the skate, a pair of truck means each including axle means carried thereby, means for mounting said pair of truck means at respectively forward and rearward locations on said skate plate means with the respective axes of said axle means of said pair of truck means disposed beneath said skate plate means, extending generally horizontally and laterally with respect to said skate plate means, and spaced from each other longitudinally of said skate plate means, and a pair of ground engaging wheel means respectively mounted for rotation upon said axle means of said pair of truck means, an improved construction for said apparatus including:

non-metallic means for providing said skate plate means comprising a unitary, molded structure formed of hardened, substantially rigid and non-deformable, synthetic resin material, said structure including as integrally formed parts thereof: an elongate, generally horizontal, upper plate portion having a substantially flat upper surface; an elongate, generally horizontal, lower plate portion spaced below said upper plate portion; an elongate, generally vertical, medial rib portion extending between laterally central zones of said upper and lower plate portions; a plurality of bracing rib portions extending between said upper and lower plate portions and laterally from said medial rib portion on both sides of the latter; front and rear, action-axes, tubular sleeve portions spaced from each other longitudinally of said plate portions and extending downwardly from said upper plate portion at least to said lower plate portion with their axes of tubularity diverging away from each other longitudinally of said upper and lower plate portions as the lower extremities of said sleeve portions are approached; and front and rear, pivot-axes, cavitated cup portions disposed respectively forwardly and rearwardly of said front and rear sleeve portions and extending downwardly from said upper plate portion with their axes of cavitation converging toward each other longitudinally of said upper and lower plate portions as the lower extremities of said cup portions are approached;

toe stop means, said structure further including as an integrally formed part thereof means presenting a pair of laterally offset holes in said skate plate means adjacent the forward end thereof; and releasable fastening means for securing said toe stop means to said skate plate means in association with either of said holes, whereby the same toe stop means and fastening means may be employed for skates intended for use on either the right foot or the left foot of a user merely by mounting said toe stop means in association with the appropriately corresponding one of said holes.

3. In roller skate apparatus of the general type wherein each skate for use in a right and left pair thereof has elongate skate plate means, means adapted for securing said skate plate means to a foot of a user with said skate plate means disposed beneath the foot of the user and longitudinally extending generally horizontally and in the general direction of intended travel of the skate, a pair of truck means each including axle means carried thereby, means for mounting said pair of truck means at respectively forward and rearward locations on said skate plate means with the respective axes of said axle means of said pair of truck means disposed beneath said skate plate means, extending generally horizontally and laterally with respect to said skate plate means, and spaced from each other longitudinally of said skate plate means, and a pair of ground engaging wheel means respectively mounted for rotation upon said axle means of said pair of truck means, an improved construction for said apparatus including:

said skate plate means comprising elongate structure provided with front and rear, action-axes, tubular sleeves spaced from each other longitudinally of said structure and extending downwardly therefrom with their axes of tubularity diverging away from each other longitudinally of said structure as the lower extremities of said sleeves are approached, and front and rear, pivot-axes, cavitated cups disposed respectively forwardly and rearwardly of said front and rear sleeves and extending downwardly from said structure with their axes of cavitation converging toward each other longitudinally of said structure as the lower extremities of said cups are approached, each of said pair of truck means including an action-axis, mounting flange having an aperture therethrough, and an elongate, pivot-axis, mounting prong, said flange and said prong of each of said pair of truck means having intersecting principal axes extending from said truck means at divergent angles with respect to each other, said mounting means including tubular cushion means for interposition between said flange of each of said truck means and the lower extremity of the corresponding of said sleeves, an elongate, releasable fastener means for each of said truck means respectively for extending through said flange thereof and the corresponding cushion means and into the corresponding of said sleeves for mounting each of said truck means on said skate plate means with the prong thereof extending into said concavity of the corresponding cup, said angle of divergence between said axes of said flange and said prong of each of said pair of truck means being substantially equal, and the angle of downward convergence between the axis of each sleeve and the axis of the associated cup means being substantially equal, whereby said pair of truck means are interchangeably mountable in association with either of said front and rear sleeves and the corresponding front or rear cap;

toe stop means, said structure further including as an integrally formed part thereof means presenting a pair of laterally offset holes in said skate plate means adjacent the forward end thereof; and releasable fastening means for securing said toe stop means to said skate plate means in association with either of said holes, whereby the same toe stop means and fastening means may be employed for skates intended for use on either the right foot or the left foot of a user merely by mounting said toe stop means in association with the appropriately corresponding one of said holes.

* * * * *